United States Patent [19]

Siglock

[11] 4,339,695

[45] Jul. 13, 1982

[54] HIGH PRESSURE SODIUM LAMP BALLAST CIRCUIT

[75] Inventor: John V. Siglock, Sierra Madre, Calif.

[73] Assignee: Unicorn Electrical Products, Anaheim, Calif.

[21] Appl. No.: 156,766

[22] Filed: Jun. 5, 1980

[51] Int. Cl.[3] ..... H05B 41/16

[52] U.S. Cl. ..... 315/276; 315/206; 315/256; 315/289; 361/35

[58] Field of Search ..... 315/125, 126, 201, 206–208, 315/256, 276, 289, 290; 361/35; 307/541

[56] References Cited

U.S. PATENT DOCUMENTS 3,727,104 4/1973 Neal et al. ..... 361/35

*Primary Examiner*—Eugene R. La Roche

*Attorney, Agent, or Firm*—Christie, Parker & Hale

[57] ABSTRACT

A ballast circuit for limiting the kilovolt-ampere rating of a ballast required to operate a high pressure sodium lamp during starting, hot restart and lamp out conditions. The ballast circuit includes a voltage limiting or clamping circuit across the secondary of a ballast transformer which responds to the voltage level and the rate of change of voltage across the secondary to activate a switch during each half cycle that the secondary of the ballast transformer goes into saturation.

8 Claims, 6 Drawing Figures

HIGH PRESSURE SODIUM LAMP BALLAST CIRCUIT

FIELD OF THE INVENTION

This invention relates to ballast circuits for high pressure sodium lamps, and more particularly, to a ballast circuit which limits the volt-ampere load during all operating conditions.

BACKGROUND OF THE INVENTION

Sodium vapor arc discharge lamps for use in street lighting, for example, are well known. Because the sodium ionizes at relatively high temperature, the lamps usually include a gas such as neon or xenon which ionizes readily and forms an initial arc. This arc is used to initially ionize mercury vapor, and the arc from the mercury vapor in turn ionizes the sodium. The start-up process for a cold lamp is typically in the order of five minutes.

The high voltage potential necessary to initiate an arc in the low pressure gases of the sodium lamp is derived from a ballast transformer connected to a constant current power source. In a typical installation, the ballast transformers for a number of lamps are connected in series across a moving coil type constant current power transformer. Because the transformer secondary of the ballast transformers looks at a very high impedance load until the arc is struck in the lamp, the voltage across the primary and secondary of the ballast transformer is initially quite high. With the rise in voltage with constant current, the power input to each lamp is therefore at a peak during initial start, and the ballast transformer will saturate. Th constant current transformer must therefore have a volt-ampere rating that is approximately four times the rating required to operate the lamps after they reach steady state operating condition. Since it is desirable to operate as many lamps as possible off of one power transformer, the relatively large start-up power requirement becomes a limiting factor.

In order to increase the number of lamps operated in a string from a single constant current transformer, one solution has been to time the starting of the lamps so that the starting is staggered. One such arrangement is described, for example, in copending application Ser. No. 091,539 filed Nov. 5, 1979, by the same inventor as the present application. However, the timing approach to limiting start-up loads by staggering the starting of the lamps requires that the ballast be tailored to provide optimum delay times, which must be selected by the contractor at the time of installation. Timing circuits further add to the cost of the equipment as well as resulting in additional maintenance costs.

SUMMARY OF THE INVENTION

The present invention provides an arrangement for limiting the worst case KVA ratings to the rating normally associated with the end of life for the lamp, which typically is only a half again as high as the rated lamp voltage. According to the present invention, the KVA requirements of the ballast during starting, hot restart and lamp outage is held at or below the rating required for end of life operation. Using the present invention, the number of lamps which can be operated from a single constant current transformer of given rating may be increased by at least 50 percent.

This improved operation is achieved by providing a ballast circuit for a high pressure sodium lamp in which a voltage limiting circuit is connected in shunt across the secondary winding of the ballast transformer between the ballast transformer and the high voltage pulsing circuit in series with the lamp. The voltage limiting circuit responds to both the level and rate of change of the voltage across the secondary during each half cycle. The limiting circuit senses when the ballast transformer goes into saturation and activates a solid state switch to connect an inductive load across the secondary winding, thereby limiting the peak voltage across the secondary. The circuitry resets itself at the end of each half cycle. The switch is not triggered until the secondary voltage is higher than the voltage necessary to trigger the high voltage pulsing circuit.

BRIEF DESCRIPTION OF THE DRAWINGS

For a better understanding of the invention reference should be made to the accompanying drawing, wherein.

DETAILED DESCRIPTION

Figure 1:
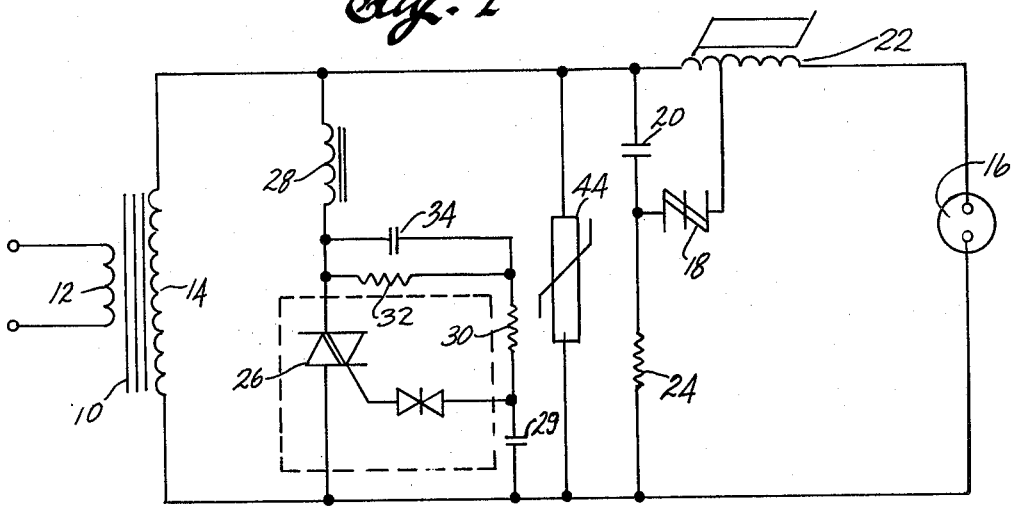
FIG. 1 is a schematic wiring diagram of the preferred embodiment of the invention.

Referring to the ballast circuit shown in FIG. 1, the numeral 10 indicates generally the ballast transformer having a primary winding 12 and secondary winding 14. Secondary winding 14 is connected to a high pressure sodium lamp 16. In a typical installation, the primary winding 12 of the ballast is connected in series with the ballast transformers of a group of lamps, the series connected primaries being connected to and driven from a moving coil type constant current transformer source. The ballast transformer 10 typically has a turns ratio of the secondary to the primary of 4:1 for a 70 watt lamp.

To initiate an ionizing arc across the lamp 16, a high voltage pulsing circuit is provided. While various types of pulsing circuits have been used, in the preferred embodiment of FIG. 1, a sidac solid state switching device 18 is used to discharge a capacitor 20 through a small number of turns of an auto-transformer 22. The core of the transformer 22 is made of ferrite or other magnetic material having a square hysteresis loop. The capacitor is charged through a resistor 24. When the voltage across the capacitor reaches a predetermined level irrespective of polarity, the solid state switch 18 closes, discharging the capacitor to the winding of the transformer 22. The winding is connected in series with the lamp across the secondary winding 14. Because of the relatively large turns ratio (30:1), the transformer 22 steps up the voltage across the lamp during the time the capacitor is discharging. This high voltage spike is sufficient to ionize the low pressure gas in the lamp to initiate an arc discharge. Once ionization of the high pressure sodium takes place, the voltage across the secondary is reduced by the low impedance of the lamp to a level which is too small to trigger the sidak so that the generation of starting pulses is interrupted.

Figure 3:
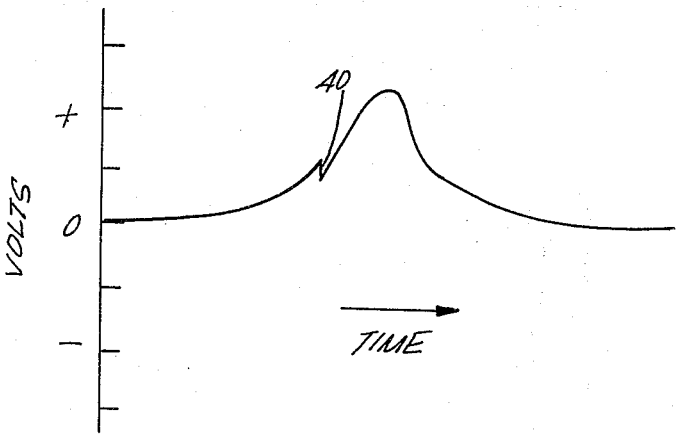
FIGS. 3 and 4 are graphical representations of the voltage waveforms present during operation without and with the circuit of the present invention.

As thus far described, the circuit is typical of conventional ballast circuits for the operation of high pressure sodium lamps. The conventional ballast transformer is designed with a low inductance primary with the core operating under all load conditions with a non-saturating flux density. During a cold start, a hot restart or a lamp out condition, the load factor on the ballast transformer increases, the volt-amp requirement being as much as twice that required for normal lamp operation. The present invention utilizes a ballast transformer that is tightly coupled (mutual inductance $M \approx 1$) with a high primary reactance. The transformer is designed to saturate under light load, such as lamp start or lamp out conditions. The flux density in the core is approximately two-thirds saturation flux density at rated lamp voltage. The voltage waveform across the secondary with the lamp out or at initial starting is therefore peaked, as shown in FIG. 3, rather than sinusoidal as in the conventional ballast transformer. A clamping or limiting circuit is provided across the transformer secondary which limits the load factor to the level required for normal lamp operation, thereby substantially increasing the number of lamps which can be connected in series across a constant current source of given capacity. The clamping circuit, as shown in FIG. 1, includes a triac 26 and series inductance 28 connected across the secondary 14. When the triac is triggered, it effectively shorts out the secondary winding 14 of the ballast transformer 10. The triac is triggered by a capacitor 29 connected between the control electrode or gate of the triac and the adjacent electrode. The capacitor 29 is charged through a network, including resistors 30 and 32 connected to one side of the secondary winding 14 through the inductance 28. The resistor 32 is bypassed by a capacitor 34 which makes the circuit sensitive to the rate at which the voltage increases across the secondary winding 14 during each half cycle. The inductance 28 is provided to protect the triac by limiting the instantaneous current when the triac 26 is triggered on.

Figure 4:
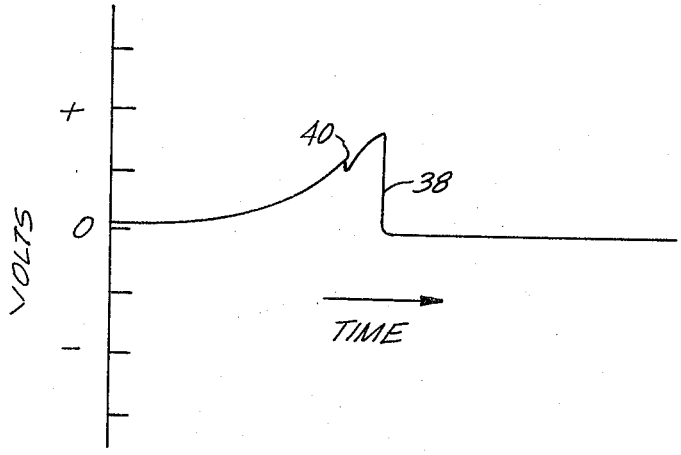

In operation, with the lamp on and operating normally, the voltage across the secondary of the ballast transformer is below 100 volts rms for lamps normally rated at 55 volts. During an initial start or with the lamp out and in the absence of the clamping circuit, the voltage on the secondary rises to a level where the core saturates, causing the voltage to peak, as indicated in FIG. 3. The network of resistors 30 and 32 and capacitors 29 and 34 detects the high rate of rise of the secondary voltage at the beginning of saturation while rejecting the rise encountered in normal lamp operation. The resulting voltage waveform across the secondary is shown in FIG. 4. When the triac is triggered, the voltage drops abruptly, as indicated at 38. The spike on the leading edge of each pulse, indicated at 40, corresponds to the triggering of the high voltage pulse generating circuit. Thus it will be seen that the triggering of the clamping circuit is delayed until after the high voltage pulse generating circuit is triggered by the secondary voltage rising above the level at which the pulse generating circuit is activated. Proper response of the clamping circuit to the rise in the secondary voltage has been achieved by making the capacitive reactance of the capacitor 34 equal to approximately two-thirds the sum of the resistors 30 and 32. The R-C network forms a band-pass filter which reduces the voltage at the control electrode at both low and high frequencies compared to an intermediate frequency. The triac 26 is not triggered by the low frequency component of the secondary voltage nor by the very high frequency component that is produced when the discharge lamp starts to ionize. The filter circuit takes advantage of the fact that in the starting mode before the lamp ionizes, when the ballast transformer saturates, the low frequency components and high frequency components of the secondary voltage are in phase, but when the ballast transformer is in the operating mode after the lamp ionizes, the high frequency components and low frequency components are out of phase. Thus the high and low frequency components tend to cancel out, preventing the triggering of the triac during the operating mode. By way of example only, an operative circuit for a 70 watt lamp can be achieved using the following impedance values:

R30=47 kohms
R32=150 kohms
C29=0.1 microfarads
C34=0.02 microfarads A varistor 44 is also connected and shunt across the secondary winding 14 to bypass the secondary inductance of the winding and provide a low impedance return for the starting pulse. This serves to protect the transformer when the lamp is out. Without the varistor, the continuous high pulsing of the transformer may lead to eventual breakdown between the secondary of the ballast transformer and its core. The varistor 44 also functions to limit the voltage on the triac 26 during starting or line transients.

Figure 2:
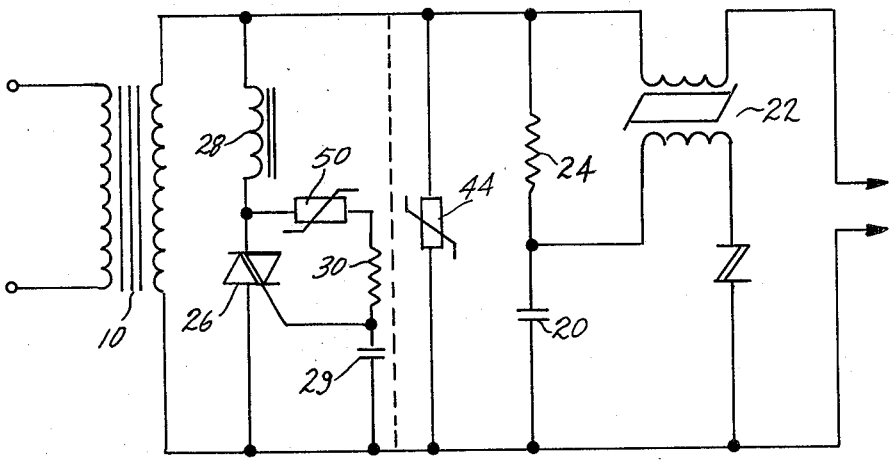
FIG. 2 is an alternative embodiment of the invention.

In the alternative circuit design shown in FIG. 2, the capacitor 34 and resistor 32 may be replaced by a varistor 50 which may be set to trigger the triac when the voltage across the secondary winding 14 reaches approximately 200 volts. When the secondary voltage exceeds 200 volts, the triac fires and shorts the secondary of the ballast transformer. The circuit of FIG. 2 has the disadvantage that it does not respond to the rate of voltage change as the transformer goes into saturation but only responds to the voltage level.

Once the triac 26 is triggered, it remains conductive during the next half cycle of the secondary voltage. Otherwise the circuit functions, as does the circuit of FIg. 1, to limit the secondary voltage during starting operation without interfering with the high voltage pulsing of the lamp to ionize the low pressure gases.

Figure 5:
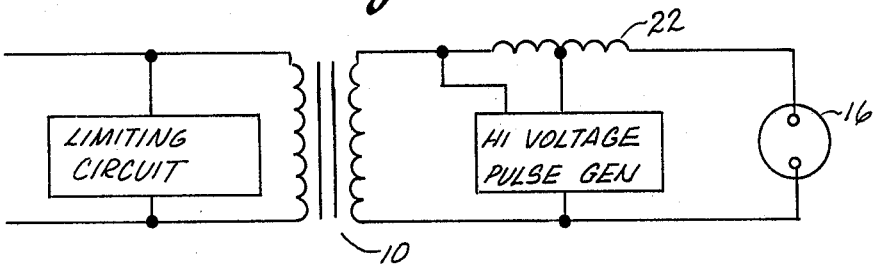
FIGS. 5 and 6 are schematic diagrams of additional embodiments of the invention.
Figure 6:
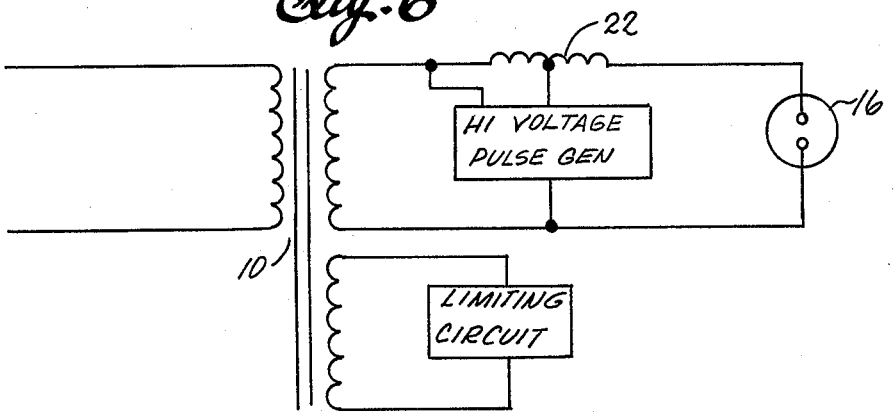

As shown in FIGS. 5 and 6, the limiting circuit 25 can be connected across the primary of the ballast transformer or connected across a tertiary winding on the ballast transformer. The operation of the circuit remains the same.

From the above description it will be seen that an improved high pressure sodium lamp ballast is provided which limits the load factor of the lamp under all operating conditions. It accomplishes this without any timing circuit for staggering the starting of different lamps in the string. By limiting the load factor under all operating conditions to a level which is no higher than the load factor of a lamp operating at the end of its useful life, the number of lamps that can be connected in series to a single transformer of given rating is substantially increased. For example, a conventional 70-watt series ballast for a high pressure sodium lamp typically has a 0.100 KVA rating for normal operation with an end-of-life requirement increasing to 0.155 KVA. The same ballast during starting, hot restart or lamp out operation has a load requirement which jumps up to 0.265 KVA. The present invention reduces the starting, hot restart and lamp out requirement to less than the end-of-life load factor of 0.155 KVA. Assuming a 30 KVA constant current transformer source plus a 5 percent line voltage drop factor, instead of the 107 lamps that can be operated using the conventional ballast, the present invention allows 184 lamps to be used, more than half again as many lamps.

What is claimed is:

1. A ballast circuit for driving a gas discharge lamp from a constant current alternating voltage source, comprising: a ballast transformer having a magnetic core and windings on the core for coupling the lamp to the voltage source, and a voltage limiting circuit including a switching element having a control electrode, the switching element being connected in a shunt current path across one of the transformer windings, and a band-pass filter network coupling the control electrode across the transformer winding, the band-pass filter network limiting the triggering of the switching device to intermediate frequencies present within the pass-band of the network.

2. The circuit of claim 1 further including: a pulsing circuit across the lamp, the voltage limiting circuit clamping the peak voltage across the lamp at a level above the voltage required to operate the pulsing circuit.

3. The circuit of claim 1 wherein the limiting circuit includes a triac having two terminals and a control electrode, the two terminals being connected across the transformer winding, and the filter network includes a resistor and capacitor in series, the control electrode of the triac being connected to the adjacent terminal of the triac by the capacitor, and an additional resistor and capacitor in parallel connected in series with said first-named resistor and capacitor and to the other terminal of the triac.

4. The circuit of claim 3 wherein the control means further includes a varistor in series with said first-named resistor and capacitor.

5. The circuit of claim 3 further including an inductance connected in series with the triac.

6. The circuit of 1 wherein the ballast transformer includes a primary winding adapted to be connected to said source and a secondary winding adapted to be connected to the lamp.

7. The apparatus of claim 6 wherein the core of the transformer saturates when the lamp load is in a high impedance state.

8. The apparatus of claim 7 wherein the flux density in the transformer core is approximately two-thirds saturation flux density at rated lamp voltage across the secondary.

* * * * *